United States Patent [19]

Forbes, 2nd

[11] 4,131,357

[45] Dec. 26, 1978

[54] SEQUENTIALLY ACTIVATED DEVELOPMENT SYSTEM FOR AN ELECTROPHOTOGRAPHIC PRINTER

[75] Inventor: Richard L. Forbes, 2nd, Webster, N.Y.

[73] Assignee: Xerox Corporation, Stamford, Conn.

[21] Appl. No.: 779,669

[22] Filed: Mar. 21, 1977

[51] Int. Cl.[2] ..... G03G 15/00; B05B 5/02

[52] U.S. Cl. ..... 355/3 DD; 118/657; 118/658

[58] Field of Search ..... 355/3 R, 3 DD, 4; 118/657, 658

[56] References Cited

U.S. PATENT DOCUMENTS

| | | | |
|---|---|---|---|
| 3,724,943 | 4/1973 | Draugelis et al. | 355/4 |
| 3,911,864 | 10/1975 | Hudson | 118/658 X |
| 3,985,099 | 10/1976 | Nagashima et al. | 118/658 |
| 4,008,686 | 2/1977 | Katakura et al. | 355/3 DD X |
| 4,030,447 | 6/1977 | Takahashi et al. | 118/658 |
| 4,050,413 | 9/1977 | Parker | 118/658 X |

*Primary Examiner*—Fred L. Braun

*Attorney, Agent, or Firm*—J. J. Ralabate; C. A. Green; H. Fleischer

[57] ABSTRACT

An apparatus in which a plurality of developing rollers deposit particles on a latent image. The developing rollers are activated and de-activated sequentially in response to the leading edge and trailing edge, respectively, of a latent image being closely adjacent to the rollers. The developer particles are transported from a storage chamber by at least one transport roller to at least one pair of feed rollers prior to its transfer to the developer rollers. A device for controlling the amount of developer particles transported by the transport roller to the feed rollers is positioned closely adjacent to the feed rollers.

26 Claims, 6 Drawing Figures

SEQUENTIALLY ACTIVATED DEVELOPMENT SYSTEM FOR AN ELECTROPHOTOGRAPHIC PRINTER

BACKGROUND OF THE INVENTION

This invention relates generally to an electrophotographic printing machine, and more particularly concerns an improved development system for use therein.

In the process of electrostatographic printing, an electrostatic latent image is recorded and reproduced in viewable form. The field of electrostatography includes electrophotography and electrography. Electrophotography employs a photosensitive medium to form, with the aid of electromagnetic radiation, the electrostatic latent image. Electrography utilizes an insulating medium to form, without the aid of electromagnetic radiation, the electrostatic latent image. Various types of reproducing machines have been developed which utilize the foregoing types of electrostatographic printing. Development, which is the act of rendering an electrostatic latent image viewable, is employed in all of the aforementioned classes of electrostatographic printing. Hereinafter, an electrophotographic printing process is described as an illustrative embodiment.

The process of electrophotographic printing, described in U.S. Pat. No. 2,297,691 issued to Carlson in 1942 and further amplified by many related patents in the art, utilizes a photosensitive element having a photoconductive insulating layer which is charged to a uniform potential to sensitize the surface thereof. The charged photoconductive surface is exposed to a light image of an original document being reproduced. As a consequence of the exposure, the charge is selectively dissipated in the irradiated areas in accordance with the light intensity reaching the surface thereof. This records an electrostatic latent image on the photoconductive surface. Development of the electrostatic latent image recorded on the photoconductive surface is achieved by bringing a developer mix into contact therewith. A typical developer mix generally comprises dyed or colored heat-settable plastic powders, known in the art as toner particles, which are mixed with coarser carrier granules, such as ferro-magnetic granules. The toner particles and carrier granules are selected such that the toner particles acquire the appropriate tribo-electric charge relative to the electrostatic latent image recorded on the photoconductive surface. When the developer mix is brought into contact with the charged photoconductive surface, the greater attractive force of the electrostatic latent image recorded thereon causes the toner particles to transfer from the carrier granules and adhere to the electrostatic latent image.

Recently, multi-color electrophotographic printing has been developed. The multi-color printing process is similar to black and white printing. In color electrophotographic printing, the light image is filtered producing successive single color light images of the original document. These colored light images expose the charged photoconductive surface to create successive single color electrostatic latent images thereon. Each single color electrostatic latent image is developed with toner particles complementary in color to the color of the filtered light image. The toner powder images are then transferred from the electrostatic latent image to a sheet of support material, in superimposed registration with one another. This multi-color powder image is then permanently affixed to the sheet of support material forming a color copy thereon.

In multi-color electrophotographic printing, it is highly desirable to utilize a belt for high speed printing. In such a process, the inter-image spacing between successive latent images is critical. Nominally, the inter-image spacing must be equal to the spacing between successive developer units so as to prevent the toner powder image of one color from having toner particles deposited thereon of a different color. It is highly desirable to reduce this inter-image spacing so as to increase the speed of the printing process.

Accordingly, it is a primary object of the present invention to improve the development system of an electrophotographic printing machine by reducing the inter-image spacing.

SUMMARY OF THE INVENTION

Briefly stated, and in accordance with the present invention, there is provided an apparatus for developing a latent image arranged to be recorded on a surface.

Pursuant to the features of the present invention, the apparatus includes a plurality of developing rollers disposed closely adjacent to the surface. Means are provided for activating and de-activating the developing roller sequentially. The sequence of activation and deactivation is in the same order.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment and method of use thereof, it will be understood that it is not intended to limit the invention to that embodiment and method of use. On the contrary, it is intended to cover all alternatives, modifications and equivalents as may be included within the spirit and scope of the invention as defined by the appended claims.

DETAILED DESCRIPTION OF THE INVENTION

Figure 1:
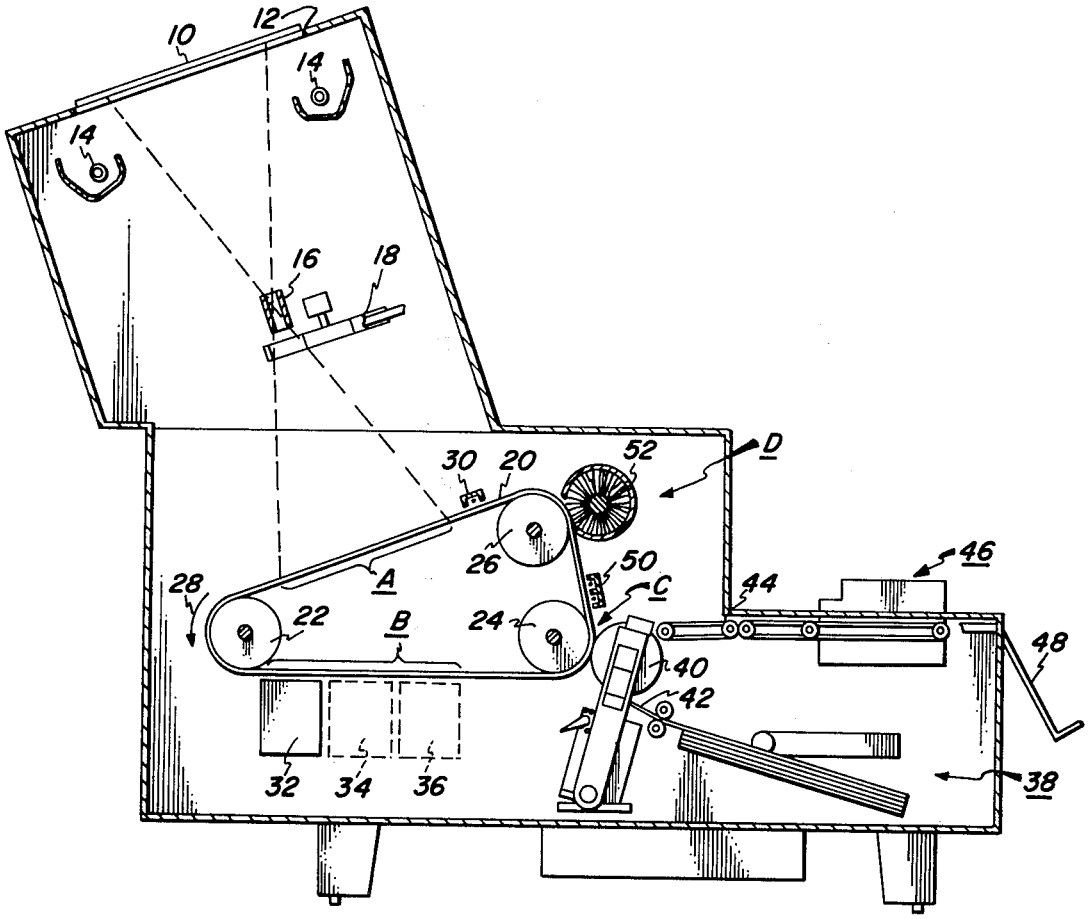
FIG. 1 is a schematic elevational view of an electrophotographic printing machine incorporating the features of the present invention therein.

With continued reference to the drawings, FIG. 1 schematically illustrates a color electrophotographic printing machine employing the features of the present invention therein. In the drawings, like reference numerals have been used throughout to designate identical elements. The electrophotographic printing machine depicted in FIG. 1 is adapted to produce color copies from a colored original document. The development system of the present invention is employed therein to achieve the foregoing. Although the development system of the present invention is particularly well adapted for use in a multi-color electrophotographic printing machine, it will become evident from the following description that it is equally suited for use in a wide variety of electrostatographic printing machines and is not necessarily limited to the particular embodiment shown herein.

Turning now to FIG. 1, an original document 10 is positioned on platen 12 to be illuminated by light source or lamps 14. While original document 10 is upon platen 12, a program system for the electrophotographic printing machine introduces a control circuit to cause successive energizations of lamps 14. Light rays reflected from original document 10 pass through lens assembly 16. The resultant light image is then transmitted through a separation filter of filter mechanism 18. This produces a light image corresponding to a single color of the color informational areas contained within original document 10. The single color light image is then projected onto the charge photoconductive surface of flexible belt 20 at exposure station A.

Endless belt 20 is entrained about three rollers 22, 24, and 26, respectively. The rollers are adapted to drive belt 20 at a constant rate in the direction of arrow 28. Prior to exposure, belt 20 is sensitized by corona generating device 30. Corona generator 30 sprays ions onto the photoconductive surface of belt 20 so as to charge it to a substantially uniform potential.

Flash exposure of the charged photoconductive belt 20 selectively discharges the charge in the irradiated areas. In this manner, successive electrostatic latent images are recorded on belt 20 corresponding to successive different color single color light images. Filter mechanism 18 interposes selected color filters into the optical light path to produce successive single color light images. Preferably, red, blue and green filters are employed. Each filter is interposed successively into the optical light path to produce a red light image, a green light image and a blue light image. This records successive single color electrostatic latent images on belt 20.

With continued reference to to FIG. 1, after an electrostatic latent image is recorded on belt 20, it continues to move in the direction of arrow 28. This advances successive single color electrostatic latent images to development station B. At development station B three individual developer units, generally designated by the reference numerals 32, 34 and 36, respectively, develop each electrostatic latent image recorded on belt 20. Preferably, the developer units are all of the type generally referred to as magnetic brush developer units. A magnetic brush developer unit employs a magnetizable developer mix of carrier granules and toner particles. The developer mix is continually brought through a directional flux field to form a brush thereof. Each developer unit advances the developer material into engagement with photoconductive belt 20. In this way, the electrostatic latent image recorded thereon attracts the toner particles from the carrier granules to the areas thereof having a greater charge. Each of the respective developer mixes contain discretely colored toner particles corresponding to the complement of the wave length of light transmitted through filter 18. Thus, a green filtered electrostatic latent image is rendered visible by depositing green absorbing magenta toner particles thereon. Blue and red latent images are developed with yellow and cyan toner particles, respectively. The detailed structure of each of the developer units hereinbefore discussed will be described hereinafter with reference to FIGS. 2 through 5, inclusive.

After the electrostatic latent image is developed, photoconductive belt 20 advances it to transfer station C. At transfer C, a sheet of support material is moved in synchronism with photoconductive belt 20 to receive the developed images in registration with one another. At this station, there is provided a sheet transport mechanism 38 for advancing successive sheets to transfer roll 40. The sheet of support material is secured releasably on transfer roll 40 and rotates in a recirculating path therewith. This permits successive toner powder images to be transferred thereto in superimposed registration with one another. Thus, yellow, cyan and magenta toner powder images are transferred to the sheet of support material in superimposed registration with one another. The transfer of the toner powder images from photoconductive belt 20 to the sheet of support material is achieved by electrically biasing transfer roll 40 to the proper polarity and magnitude.

After a plurality of toner powder images have been transferred, in registration with one another, to support material 42, the sheet is stripped from transfer roll 40. Conveyer 44 then advances the sheet of support material with the toner powder images thereon to a fuser assembly, generally indicated by the reference numeral 46. Fuser 46 generates sufficient heat to permanently affix the multi-color toner powder image to sheet 42. After fusing, the finished color copy is discharged into catch tray 48 enabling the machine operator to readily remove it therefrom.

Invariably, some residual toner particles adhere to photoconductive belt 12 after transfer of the toner powder images therefrom to support material 42. These residual particles are removed from photoconductive belt 20 as it passes through cleaning station D. At cleaning station D, a cleaning corona generating device 50 neutralizes the electrostatic charge remaining on the residual toner particles and that of photoconductive belt 20. The neutralized toner particles are then removed from photoconductive belt 20 by rotatably mounted brush 52 in contact therewith.

It is believed that the foregoing description is sufficient for purposes of the present application to illustrate the general operation of an electrophotographic printing machine embodying the teachings of the present invention therein.

Figure 2:
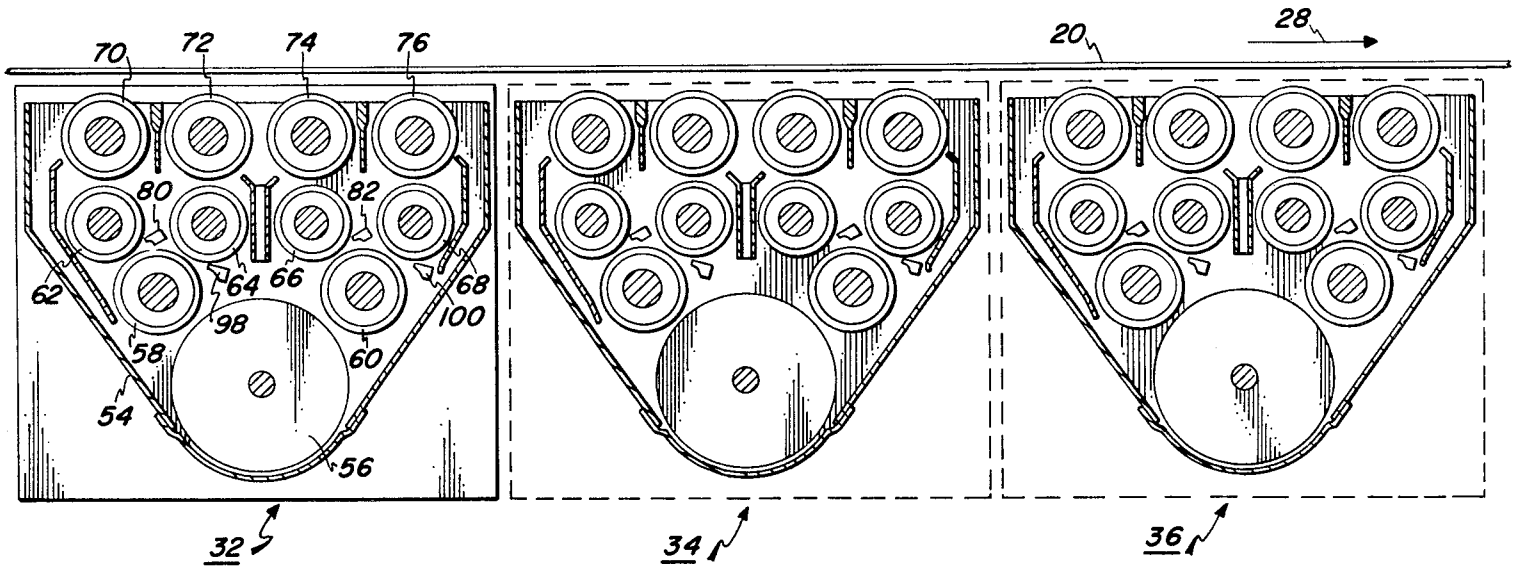
FIG. 2 shows an elevational view of the development system employed in the FIG. 1 printing machine.

Referring now to FIG. 2, the development system of the present operation is depicted therein in greater detail. The multi-color development system includes three developer units 32, 34 and 36. These developer units are depicted in an elevational sectional view to indicate more clearly the components included therein. Only developer unit 32 will be described in detail as developer units 34 and 36 are nearly identical thereto, the distinction between each developer unit being the color of the toner particles contained therein. Developer unit 32 may have yellow toner particles, unit 34 magenta toner particles, and unit 36 cyan toner particles, although different color combinations may be used. For purposes of explanation, developer unit 32 will be described hereinafter in greater detail.

The principle components of developer unit 32 are developer housing 54, paddle wheel 56, transport rolls 58 and 60, feed rollers 62, 64, 66 and 68, and developer rollers 70, 72, 74 and 76. Paddle wheel 56 is a cylindrical member with buckets or scoops located about the periphery thereof and adapted to rotate so as to elevate the developer mix from the lower regions of chamber 78 of housing 54. When the developer mix reaches a region closely adjacent to transport rollers 58 and 60, it is lifted from paddle wheel buckets thereto. Alternate buckets of paddle wheel 56 have apertures in the root diameter so that the developer mix carried in these areas is not carried to transport rollers 58 and 60, but, instead, falls back to the lower region of chamber 78 of housing 54. As the developer mix falls back to the lower region, it cascades and mixes with the carrier granules and toner particles remaining in the lower regions thereof. This generates a strong tribo-electric charge between the carrier granules and toner particles. As the developer mix in the paddle wheel buckets approaches transport rollers 58 and 60, the magnetic fields produced by the fixed magnets therein attract the developer mix thereto. Transport rollers 58 and 60 move the developer mix in an upwardly direction. A surplus of developer material is furnished.

The developer material on transport rollers 58 and 60 is advanced to feed rollers 62 and 66, respectively, by the action of the magnetic field produced by the fixed magnets therein. Flow splitters or blades 80 and 82 meter the developer material thickness on feed rollers 62 and 66, respectively, and divert the excess back to transport rollers 58 and 60. Similarly, the remaining developer material on transport rollers 58 and 60 is advanced to feed rollers 64 and 68, respectively, by the magnetic field produced by the fixed magnets therein. Flow splitters or blades 98 and 100 meter the correct developer material thickness on feed rollers 64 and 68. The excessive developer material is diverted back to chamber 78 of housing 54.

Each feed roller is associated with one developer roller and supplies developer material thereto. Thus, each developer roller is independently fed with developer material. It is evident that the developer material on each of the transport rollers is split into two flow paths and is advanced by the respective feed rollers to their corresponding developer rollers independent of one another. This insures that each developer roll receives an adequate supply of developer material and prevents starvation thereof. In the past, when each developer roll advanced the developer material to the next successive developer roll, there was a possibility that the last developer roll would only receive carrier granules with substantially few or no toner particles thereon inasmuch as the toner particles would have already been attracted to the latent image. The present approach of independently feeding each developer material prevents the foregoing from occurring.

Figure 3:
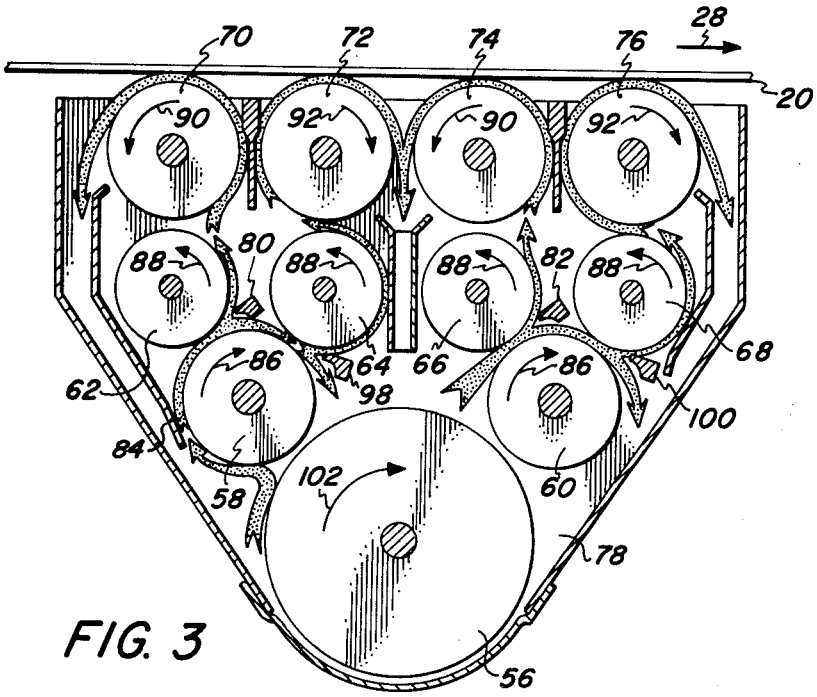
FIG. 3 depicts an elevational view of the developer material flow path in one of the FIG. 2 developer units.

Referring now to FIG. 3, the flow path of the developer material will be discussed in greater detail as well as the direction of rotation of each of the developer rollers, feed rollers and transport rollers.

As shown in FIG. 3, paddle wheel 56 advances developer material 84 in a upwardly direction to transport rollers 58 and 60. Transport rollers 58 and 60 rotate in the same direction, i.e. in the direction of arrow 86. Flow splitters 80 and 82 meter a portion of the developer material flow onto feed roller 62 and 66, respectively, with the remainder of the developer material flow being advanced to feed rollers 64 and 68, respectively. All of the feed rollers rotate in the same direction, i.e. that of arrow 88. Developer roller 70 rotates in the direction of arrow 90 as does developer roller 74. However, developer rollers 72 and 76 rotate in the direction of arrow 92, i.e. opposed to the direction of rotation of developer rollers 70 and 74. Thus, it is evident that developer roller 70 rotates in an opposed direction to developer roller 72. Similarly, developer roller 74 rotates in the opposite direction to developer roller 76. In this manner, at least a pair of developer rollers are rotating in the same direction as the movement of belt 20 while a pair of developer rollers are rotating in a direction opposed thereto. Each developer roller is activated as the lead edge of the latent image recorded on photoconductive belt 20 is closely adjacent thereto. Similarly, the developer roller is de-activated when the trailing edge of the latent image passes closely adjacent thereto. This is achieved by timing marks 11 on a photoconductive belt 20. The edges of photoconductive belt 20 have a plurality of substantially equally spaced slits 11 therein. On one side of the slit 11 is located a photosensor 15 with a light source 13 being disposed on the other side thereof. A first slit corresponds to the lead edge of the latent image and, after a plurality of slits have passed between the photosensor and light source, a second slit corresponds to the trailing edge of the latent image. Thus, the photosensor 15 develops electrical pluses each time a slit 11 passes between the photosensor 15 and light source 13. These electrical pulses may be employed to provide an indication of the location of the lead and trailing edges of the latent image. Hence, as the lead edge of the latent image approaches developer roller 70, this developer roller is activated. Similarly, developer rollers 72, 74 and 76 are also activated as the lead edge approaches them. Deactivation occurs when the trailing edge approaches the nip between the developer roller and photoconductive belt 20. As the trailing edge approaches the nip defined between developer roller 70 and photoconductive belt 20, developer roller 70 is deactivated, i.e. developer material is no longer furnished thereto. This permits the space between successive electrostatic latent images to be the distance between adjacent developer rollers. Thus, the spacing between the centers of developer rollers 70 and 72 is the minimum inter-image space. The foregoing is required in order to insure that the toner powder images from each successive developer unit, i.e. developer units 32, 34 and 36, are not deposited erroneously on an already developed electrostatic latent image. The drive system for sequentially activating each developer roll will be described hereinafter with reference to FIG. 5.

Figure 4:
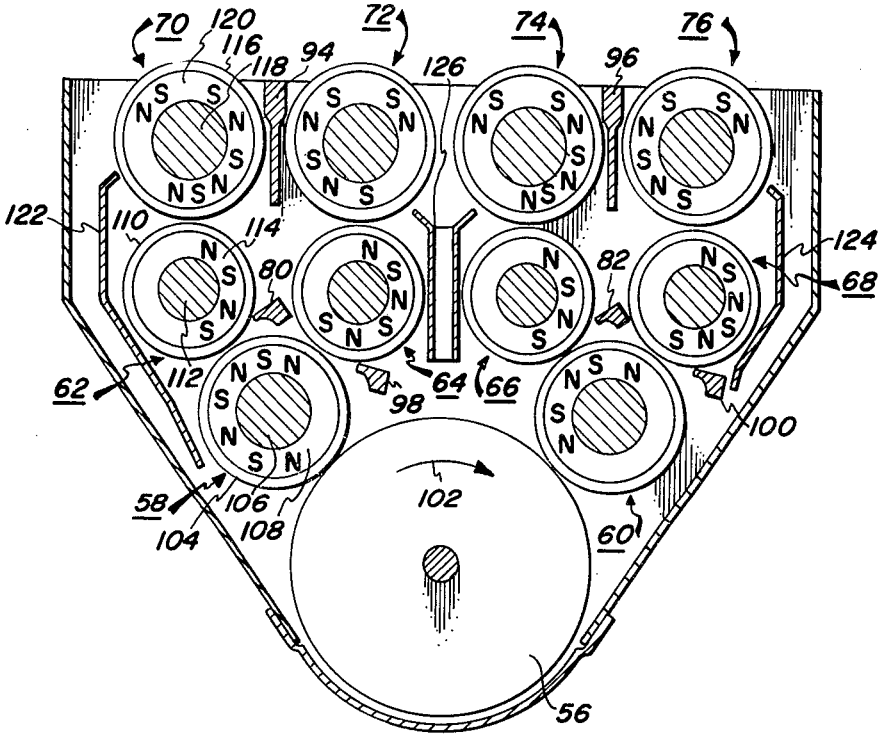
FIG. 4 shows an elevational view of one of the developer units used in the FIG. 2 development system.

As shown in FIG. 4, baffle plates 94 and 96 further insure that the developer material on developer rollers 70 and 72 and 74 and 76 do not co-mingle with one another. Blades 98 and 100 also assist in splitting the flow between the respective feed rollers. It should be noted that the developer material passes on the same side of feed roller 62 and developer roller 70. However, the developer material passes on one side of feed roll 64 and the side opposed thereto on developer roll 72. Thus, in this latter case, the developer material is traversing a serpentine path i.e. an S-shaped path. Similarly, the developer material passes on the same side of feed roller 66 as developer roll 74. However, it passes on one side of feed roller 68 and the side opposed thereto on developer roller 76. Hence, once again, the developer material moves in a serpentine path passing from one side of feed roller 68 to the side opposed thereto on developer roller 76.

Referring now to FIG. 4, each developer roller feed roller, and transport roller are substantially identical to one another. Thus, only developer roller 70, feed roller 62 and transport roller 58 will be described in detail. The only distinctions between the developer rollers is the direction of rotation thereof. This distinction does not apply to the feed rollers and transport rollers inasmuch as they rotate in the same direction with respect to one another. It should be noted that paddle wheel 56 rotates in the direction of arrow 102, i.e. the same direction as that of transport rollers 58 and 60. As shown in FIG. 4, transport roller 58 includes a non-magnetic tubular member 104 preferably made from aluminum having an irregular or roughened exterior surface. Tubular member 104 is journaled for rotation and rotated by the drive system of FIG. 5. A shaft 106 made preferably of steel is concentrically mounted within tubular member 104 and serves as a fixed mounting for magnetic member 108. Magnetic member 108 has a discrete pole pattern disposed thereabout so as to advance the developer material on one side thereof. On the other side thereof, no magnetic field is produced and the developer material cascades in a downwardly direction onto paddle wheel 56 so as to be co-mingled with the remaining developer material in housing 54.

Feed roller 62 includes a non-magnetic tubular member 110 having an irregular or roughened surface. Tubular member 110 is journaled for rotation. A shaft 112 made, preferably, of steel is concentrically mounted within tubular member 110 and functions as a fixed mounting for magnetic member 114. Magnetic member 114 includes a discrete pole pattern so that the magnetic field produced thereby attracts the developer material to one side thereof. The other side has substantially no magnetic field permitting the developer material to descend freely therefrom in a downwardly direction into the sump of the developer housing.

Developer roller 70 includes a non-magnetic tubular member 116, preferably, made from aluminum having an irregular or roughened exterior surface. Tubular member 116 is journaled for rotation. A shaft 118 made, preferably, of steel is concentrically mounted within tubular member 116. Shaft 118 functions as a fixed mounting for magnetic member 120. Magnetic member 120 has a discrete pole pattern thereon so that in the region closely adjacent to photoconductive belt 20 there is no pole associated therewith. Thus, the nip region, i.e. the development zone between photoconductive belt 20 and tubular member 116, is substantially field free. The foregoing pole arrangement applies to all of the developer rollers. This improves development and readily facilitates the attraction of the toner particles from the carrier granules to the latent image recorded on photoconductive belt 20. The denuded carrier granules and residual developer material from developer rollers 70 and 76 pass into a chute defined by baffle plates 122 and 124 which guide it in a downwardly direction into the lower region of housing 54. Similarly, chute 126 receives the denuded carrier granules and residual developer material from developer rollers 72 and 74 and guides this material onto paddle wheel 56 for subsequent remixing and recirculation. Preferably, blades 80, 98, 82 and 100 are made from a rigid, extruded aluminum. Similarly, baffle plates 94 and 96 are made from a rigid, extruded aluminum.

Figure 3A:
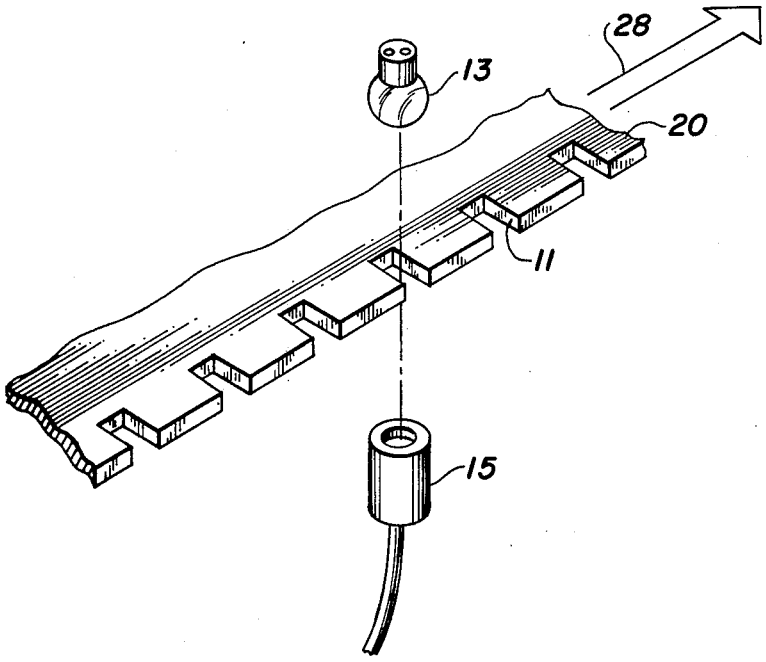
FIG. 3*a* illustrates a fragmentary perspective view of the timing arrangement employed in the FIG. 1 printing machine.
Figure 5:
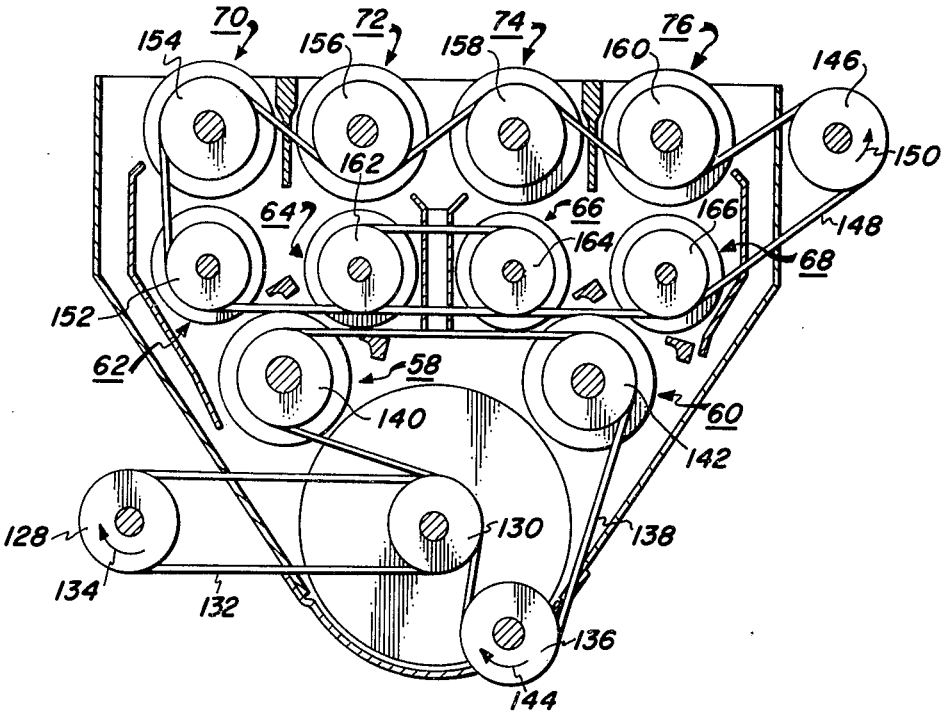
FIG. 5 shows, in elevation, the drive system for the FIG. 4 developer unit.

Turning now to FIG. 5, the drive system for activating sequentially each developer roller will be described hereinafter. Motor 128 is coupled to sprocket gear 130 mounted on paddle wheel 56 by chain 132. Thus, as motor 128 rotates in the direction of arrow 134, paddle wheel 56 rotates in the same direction. Preferably, motor 128 is a constant speed DC motor. Transport rollers 58 and 60 are coupled to motor 136 via chain 138 entrained about sprocket gears 140 and 142, respectively. Sprocket gear 140 is mounted on transport roller 58 with sprocket gear 142 being mounted on transport roller 60. As motor 136 rotates in the direction of arrow 144, transport rollers 58 and 60 rotate in the same direction. Motor 146 is coupled to developer rollers 70, 72, 74, 76 and feed rollers 62, 64, 66, and 68 via chain 148. Rotation of motor 146 in the direction of arrow 150 drives developer rollers 70 and 74 in the same direction, while developer rollers 72 and 76 rotate in a direction opposed thereto. Sprocket gears 154, 156, 158 and 160 mounted on developer rolls 70, 72, 74 and 76, respectively, mesh with chain 148 to couple motor 146 thereto. Similarly, chain 158 is entrained about gears 152, 162, 164 and 166 mounted on feed rollers 62, 64, 66 and 68 respectively. Gears 152, 162, 164 and 166 are coupled to feed roller 62, 64, 66 and 68 through individual electromagnetic clutches. Preferably, these clutches are Model No. SBEC12C-S made by the Electroid Company. Energization of the clutch couples the respective sprocket gear to the corresponding feed roller. Thus, energization of the clutch having sprocket gear 152 mounted thereon rotates feed roller 62 in the same direction as motor 146, i.e. in the direction of arrow 150. Similarly, energization of the clutches associated with sprocket gears 162, 164 and 166 activates the corresponding feed rollers 64, 66 and 68 to rotate therewith. Each clutch associated with the corresponding feed rollers are activated sequentially. Thus, when the circuitry processing the electrical signal from the photosensor 15 (FIG. 3*a*) detects that the lead edge is approaching developer roll 154, the clutch associated with feed roller 62 is activated coupling sprocket gear 152 thereto. This causes feed roller 62 to rotate and advance developer material to developer roller 70. Similarly, as the lead edge approaches developer roll 72, the clutch associated with feed roller 64 is activated engaging sprocket gear 162 causing feed roller 64 to rotate therewith. In this manner, developer material is advanced to developer roller 72. In much the same way, developer roller 74 and 76 receive developer material from their corresponding feed rollers 66 and 68.

As the trailing edge of the latent image approaches the developer roll, for example developer roller 70, a signal is sent to the clutch associated with feed roller 62 de-energizing it. De-energizing of the clutch associated with feed roller 62 disengages sprocket gear 152 from feed roller 62. Feed roller 62 now no longer rotates and additional developer material is no longer furnished to developer roller 70. Hence, developer roller 70 no longer supplies developer material to the latent image. In a similar manner, feed rollers 64, 66 and 68 are deactivated when the trailing edge of the latent image approaches the associated developer roller, i.e. developer rollers 72, 74 and 76, respectively. In this manner, the development system includes a plurality of developer rollers which are sequentially activated and deactivated in the same order.

In recaptiulation, the apparatus of the present invention develops successive latent images recorded on a photoconductive belt. The development system comprises a plurality of developer rollers which are sequentially activated and de-activated in the same order. The foregoing permits the reduction of inter-image spacing to that of the spacing between adjacent developer rollers in the same developer unit. Each developer roller is independently fed with developer material. Adjacent developer rollers rotate in opposed directions. The foregoing development apparatus significantly improves the resultant copy quality achieved in an electrophotographic printing machine.

It is, therefore, evident that there has been provided in accordance with the present invention, a development system that fully satisfies the objects, aims and advantages hereinbefore set forth. While this system has been described in conjunction with a specific embodiment and method of use therefor, it is evident that many alternatives, modifications, and variations will be apparent to those skilled in the art. Accordingly, it is intended to embrace all such alternatives, modifications and variations as fall within the spirit and scope of the appended claims.

What is claimed is:

1. An apparatus for developing a latent image arranged to be recorded on a surface, including:

a plurality of developing rollers disposed closely adjacent to the surface;

means for activating and de-activating said plurality of developing rollers sequentially with said plurality of developing rollers being activated and de-activated in the same order;

a housing defining a chamber for storing a supply of developer material therein;

a cylindrical member having a plurality of buckets disposed about the periphery thereof for advancing developer material from the chamber of said housing:

at least one transport roller disposed adjacent to the buckets of said cylindrical member and arranged to receive the developer material therefrom;

at least a pair of feed rollers disposed closely adjacent to said transport roller for receiving developer material therefrom, each of said pair of feed rollers being associated with one of said developing rollers for furnishing an individual supply of developer material thereto; and at least one blade member positioned closely adjacent to said pair of feed rollers to control the amount of developer material advanced to each of said pair of feed rollers from said transport roller.

2. An apparatus as recited in claim 1, wherein said activating and de-activating means activate each of said plurality of developing rollers in response to the leading edge of the latent image recorded on the surface being closely adjacent thereto and de-activate each of said plurality of developing rollers in response to the trailing edge of the latent image recorded on the surface being closely adjacent thereto.

3. An apparatus as recited in claim 1, wherein a first one of said plurality of developing rollers rotates in a first direction and a second one of said plurality of developing rollers rotates in a second direction opposed to the first direction with said first one of said plurality of developing rollers and said second one of said plurality of developing rollers being closely adjacent to one another.

4. An apparatus as recited in claim 1, wherein each of said plurality of developing rollers includes:

a magnetic member; and a rotatably mounted non-magnetic tubular member interfit telescopically over said magnetic member.

5. An apparatus as recited in claim 4, wherein said magnetic member includes a discrete pole pattern for generating a variable strength magnetic field, said magnetic member being oriented so that the region adjacent the surface arranged to have the latent image recorded thereon is substantially field free.

6. An apparatus as recited in claim 1, wherein said transport roller includes:

a magnetic member having a discrete pole pattern for generating a variable strength magnetic field; and a rotatably mounted non-magnetic tubular member interfit telescopically over said magnetic member.

7. An apparatus as recited in claim 1, wherein each one of said pair of feed rollers includes:

a magnetic member having a discrete pole pattern for generating a variable strength magnetic field; and a rotatably mounted, non-magnetic tubular member interfit telescopically over said magnetic member.

8. An apparatus for developing a latent image arranged to be recorded on a surface, including:

a housing defining a chamber for storing a supply of developer material therein;

at least one rotatably mounted transport roller arranged to advance the developer material from the chamber in said housing;

at least a pair of rotatably mounted feed rollers, said feed rollers rotating in a direction opposed to the direction of rotation of said transport roller;

means for controlling the amount of developer material advanced to each of said feed rollers from said transport roller; and at least a pair of developing rollers disposed closely adjacent to said pair of feed rollers, one of said pair of developing rollers rotating in the same direction as said pair of feed rollers and the other of said pair of developing rollers rotating in a direction opposed thereto so that in one path the developer material flows from one side of one of said pair of said feed rollers to the side of one of said pair of developing rollers opposed thereto and in the other path the developer material flows from the side of the other of said pair of feed rollers to the side of the other of said pair of developing rollers corresponding thereto.

9. An apparatus as recited in claim 8, further including a cylindrical member having a plurality of buckets disposed about the periphery thereof for advancing developer material from the chamber of said housing to said transport roller.

10. An apparatus as recited in claim 9, wherein said controlling means includes at least one blade member positioned closely adjacent to said pair of feed rollers.

11. An apparatus as recited in claim 10, wherein:

said transport roller includes a magnetic member having a discrete pole pattern for generating a variable strength magnetic field, and a rotatably mounted non-magnetic tubular member interfit telescopically over said magnetic member;

each one of said pair of feed rollers include a magnetic member having a discrete pole pattern for generating a variable strength magnetic field and a rotatably mounted, non-magnetic tubular member interfit telescopically over said magnetic member; and each one of said pair of developing rollers includes a magnetic member having a discrete pole pattern for generating a variable strength magnetic field, and a rotatably mounted non-magnetic tubular member interfit telescopically over said magnetic member.

12. An apparatus as recited in claim 11 wherein said developing roller magnetic member is oriented so that the region adjacent the surface arranged to have the latent image recorded thereon is substantially field free.

13. An apparatus as recited in claim 12, further including means for activating and de-activating said plurality of developing rollers sequentially with said plurality of developing rollers being activated and de-activated in the same order.

14. An electrophotographic printing machine of the type having an electrostatic latent image recorded on a photoconductive member, wherein the improvement includes:

a plurality of developing rollers disposed closely adjacent to the photoconductive member;

means for activating and de-activating said plurality of developing rollers sequentially with said plurality of developing rollers being activated and de-activated in the same order;

a housing defining a chamber for storing a supply of developer material therein;

a cylindrical member having a plurality of buckets disposed about the periphery thereof for advancing developer material from the chamber of the housing;

at least one transport roller disposed adjacent to the buckets of said cylindrical member and arranged to receive the developer material therefrom;

at least a pair of feed rollers disposed closely adjacent to said transport roller for receiving developer material therefrom, each of said pair of feed rollers being associated with one of said developing rollers for furnishing an individual supply of developer material thereto; and at least one blade member positioned closely adjacent to said pair of feed rollers to control the amount of developer material advanced to each of said pair of feed rollers.

15. A printing machine as recited in claim 14, wherein said activating and de-activating means activates each of said plurality of developing rollers in response to the leading edge of the latent image recorded on the photoconductive member being closely adjacent thereto and deactivates each of said plurality of developing rollers in response to the trailing edge of the latent image recorded on the photoconductive member being closely adjacent thereto.

16. A printing machine as recited in claim 14, wherein a first one of said plurality of developing rollers rotates in a first direction and a second one of said plurality of developing rollers rotates in a second direction opposed to the first direction with said first one of plurality of developing rollers and said second one of said plurality of developing rollers being closely adjacent to one another.

17. A printing machine as recited in claim 14, wherein each of said plurality of developing rollers includes:

a magnetic member; and a rotatably mounted non-magnetic tubular member interfit telescopically over said magnetic member.

18. A printing machine as recited in claim 17, wherein said magnetic member includes a discrete magnetic pole pattern for generating a variable strength magnetic field, said magnetic member being oriented so that the region adjacent the photoconductive member is substantially field free.

19. A printing machine as recited in claim 14, wherein said transport roller includes:

a magnetic member having a discrete pole pattern for generating a variable strength magnetic field; and a rotatably mounted non-magnetic tubular member interfit telescopically over said magnetic member.

20. A printing machine as recited in claim 14, wherein each of said pair of feed rollers includes:

a magnetic member having a discrete pole pattern for generating a variable strength magnetic field; and a rotatably mounted non-magnetic tubular member interfit telescopically over said magnetic member.

21. An electrophotographic printing machine of the type having an electrostatic latent image recorded on a photoconductive member, wherein the improvement includes:

a housing defining a chamber for storing a supply of developer material therein;

at least one rotatably mounted transport roller arranged to advance the developer material from the chamber in said housing;

at least a pair of rotatably mounted feed rollers, said feed rollers rotating in a direction opposed to the direction of rotation of said transport rollers;

means for controlling the amount of developer material advanced to each of said feed rollers from said transport roller; and at least a pair of developing rollers disposed closely adjacent to said pair of feed rollers, one of said pair of developing rollers rotating in the same direction as said pair of feed rollers and the other of said pair of developing rollers rotating in a direction opposed thereto so that in one path the developer material flows from one side of one of said pair of feed rollers to the side of one of said pair of developing rollers opposed thereto and in the other path the developer material flows from one side of the other of said pair of feed rollers to the side of the other of said pair of developing rollers corresponding thereto.

22. A printing machine as recited in claim 21, further including a cylindrical member having a plurality of buckets disposed about the periphery thereof for advancing developer material from the chamber of said housing to said transport roller.

23. A printing machine as recited in claim 22, wherein said controlling means includes at least one blade positioned closely adjacent to said pair of feed rollers.

24. A printing machine as recited in claim 23, wherein:

said transport roller includes a magnetic member having a discrete pole pattern for generating a variable strength magnetic field, and a rotatable non-magnetic tubular member interfit telescopically over said magnetic member;

each one of said pair of feed rollers includes a magnetic member having a discrete pole pattern for generating a variable strength magnetic field, and a rotatably mounted non-magnetic tubular member interfit telescopically over said magnetic member; and each one of said pair of developing rollers includes a magnetic member having a discrete pole pattern for generating a variable strength magnetic field, and a rotatably mounted non-magnetic tubular member interfit telescopically over said magnetic member.

25. A printing machine as recited in claim 24, wherein said magnetic member of each of said developing rollers is oriented so that the region adjacent said photoconductive member is substantially field free.

26. A printing machine as recited in claim 25, further including means for activating and de-activating said plurality of developing rollers sequentially with said plurality of developing rollers being activated and de-activated in the same order.

* * * * *